US008439452B2

(12) United States Patent
Cox et al.

(10) Patent No.: US 8,439,452 B2
(45) Date of Patent: May 14, 2013

(54) PAINT BRUSH WITH REINFORCED FERRULE CONSTRUCTION

(76) Inventors: Jon Terry Cox, Riverton, WY (US); Jon Paul Cox, Riverton, WY (US)

( * ) Notice: Subject to any disclaimer, the term of this patent is extended or adjusted under 35 U.S.C. 154(b) by 0 days.

(21) Appl. No.: 13/443,078

(22) Filed: Apr. 10, 2012

(65) Prior Publication Data

US 2012/0193968 A1 Aug. 2, 2012

Related U.S. Application Data

(62) Division of application No. 11/825,516, filed on Jul. 6, 2007, now Pat. No. 8,171,594.

(51) Int. Cl.

| | |
|---|---|
| ***A46B 5/00*** | (2006.01) |
| ***A46B 5/02*** | (2006.01) |
| ***A46B 5/06*** | (2006.01) |

(52) U.S. Cl.
USPC ..... 300/21; 15/193

(58) Field of Classification Search ..... 15/193; *A46B 5/00, 5/02, 5/06*
See application file for complete search history.

(56) References Cited

U.S. PATENT DOCUMENTS 3,386,119 A * 6/1968 Shulman ..... 15/193

* cited by examiner

*Primary Examiner* — Monica Carter
*Assistant Examiner* — Stephanie N Berry
(74) *Attorney, Agent, or Firm* — Robert L. Lundstrom

(57) ABSTRACT

A method for making a paint brush includes coupling a plurality of filaments to a handle inside a sleeve with the handle extending out of the sleeve. At least a portion of the handle and the sleeve are coated with a substantially impermeable coating to form a seal around an interface between the sleeve and the handle without covering the plurality of filaments.

13 Claims, 12 Drawing Sheets

PAINT BRUSH WITH REINFORCED FERRULE CONSTRUCTION

PRIORITY CLAIM

This patent application is a Divisional Application and claims benefit of U.S. patent application Ser. No. 11/825,516, filed on Jul. 6, 2007, now U.S. Pat. No. 8,171,594 which is incorporated by reference herein in its entirety for all purposes.

BACKGROUND OF THE INVENTION

1. Field of the Invention

The present invention relates generally to paint brushes.

2. Related Art

Traditional paint brushes have an elongated handle with bristles, filaments, or other application medium attached to an end of the elongated handle. Often, the bristles are attached to the handle by way of a sleeve or "ferrule" that circumscribes an end of the bristles and a mating end of the handle. A plug is often placed between the bristles to spread the bristles outward toward the sleeve so that the bristles are wedged between the plug and the sleeve. The bristles and plug are often adhered together by commonly known adhesives, such as epoxy resins and the like. Together the bristles, the plug, and the adhesive form a "knot" that retains the bristles in the sleeve. Additionally, the sleeve can be adhered to the handle by way of a common adhesive, and/or other types of fasteners such as screws, nails, brads, and the like.

In use, the bristles or filaments of the paint brushes are dipped into a liquid coating, such as paint, stain, and the like, so that coating is collected on the bristles. The coating can then be transferred from the bristles to a surface by pressing the coating covered bristles onto the surface and moving the brush across the surface. When nearly all of the coating has been transferred from the bristles to the surface, the brush must be dipped back into the paint to collect more paint that can then be transferred to the surface.

Many attempts have been made to improve the traditional paint brush. For example, many paint brushes have plastic handles instead of wood handles. Additionally, some paint brushes have hollow handles that can be filled with paint which runs out of the handle and into the bristles while painting so as to reduce the frequency of dipping the brush into the paint.

Unfortunately, traditional paint brushes, and even many of the improvements made to such brushes, continue to present problems to painters. For example, frequent dipping of the brush into the paint reduces the overall efficiency of a painter. It will be appreciated that the time required to dip a brush reduces time the painter could be brushing paint onto a surface. Thus, reducing the need to dip the brush to collect more paint increases the productivity and overall efficiency of a painter. Unfortunately, attempts to increase the paint reservoir in a brush, such as the hollow handle that can be filled with paint, are difficult to clean up and can easily become clogged with dried paint.

Another common issue with traditional paint brushes is that many painters prefer to use a brush with very fine bristles or filaments with relatively small diameters, because of the feel and precision of the brush during a brush stroke and the smoothness of the surface finish of the resulting coat of paint. Unfortunately, finer bristles and smaller filaments cause a floppier or weaker brush.

Yet another problem with traditional brushes is that they have a generally square shape with a brush face oriented perpendicular to the sides of the brush. It will be appreciated that painting many surfaces requires the painter to gradually apply pressure to a brush against the surface so as to blend in or "feather" new paint on top of paint already on the surface. Unfortunately, a brush face perpendicular to the sides of the brush as found on traditional paint brushes makes such feathering difficult to accomplish.

Additionally, many painters prefer the feel of traditional wood handles over newer plastic handles, however, traditional wood handles, over time, absorb paint and solvents which tend to swell and contract the handle, thereby loosening the handle or brush knot in the ferrule. This loosening can cause the handle to move in relation to the brush head. It will be appreciated that such movement can make it difficult to precision paint.

SUMMARY OF THE INVENTION

The inventors of the present invention have recognized that it would be advantageous to develop a method and device for increasing the strength of the connection between a brush head and a handle so as to reduce movement of the handle in relation to the brush head.

Thus, in one aspect, the present invention provides for a paint brush including a sleeve circumscribing a portion of a handle and a portion of a plurality of bristles. A plug can be coupled to the handle. The plug can extend away from the handle into the plurality of bristles to form a space between the bristles. An extension and a recess can be formed between the handle and the resin with the extension extending from one of the handle or resin and into the recess in the other of the handle or resin.

The present invention also provides for a method for making a paint brush including placing a plurality of bristles inside a sleeve. A resin can be applied into the sleeve to contact the plurality of bristles. A handle can be inserted into the sleeve to contact the resin. An extension formed in one of the handle or the resin can be fitted into a recess formed in the other of the handle and the resin.

Additional features and advantages of the invention will be apparent from the detailed description which follows, taken in conjunction with the accompanying drawings, which together illustrate, by way of example, features of the invention.

DETAILED DESCRIPTION

Figure 1:
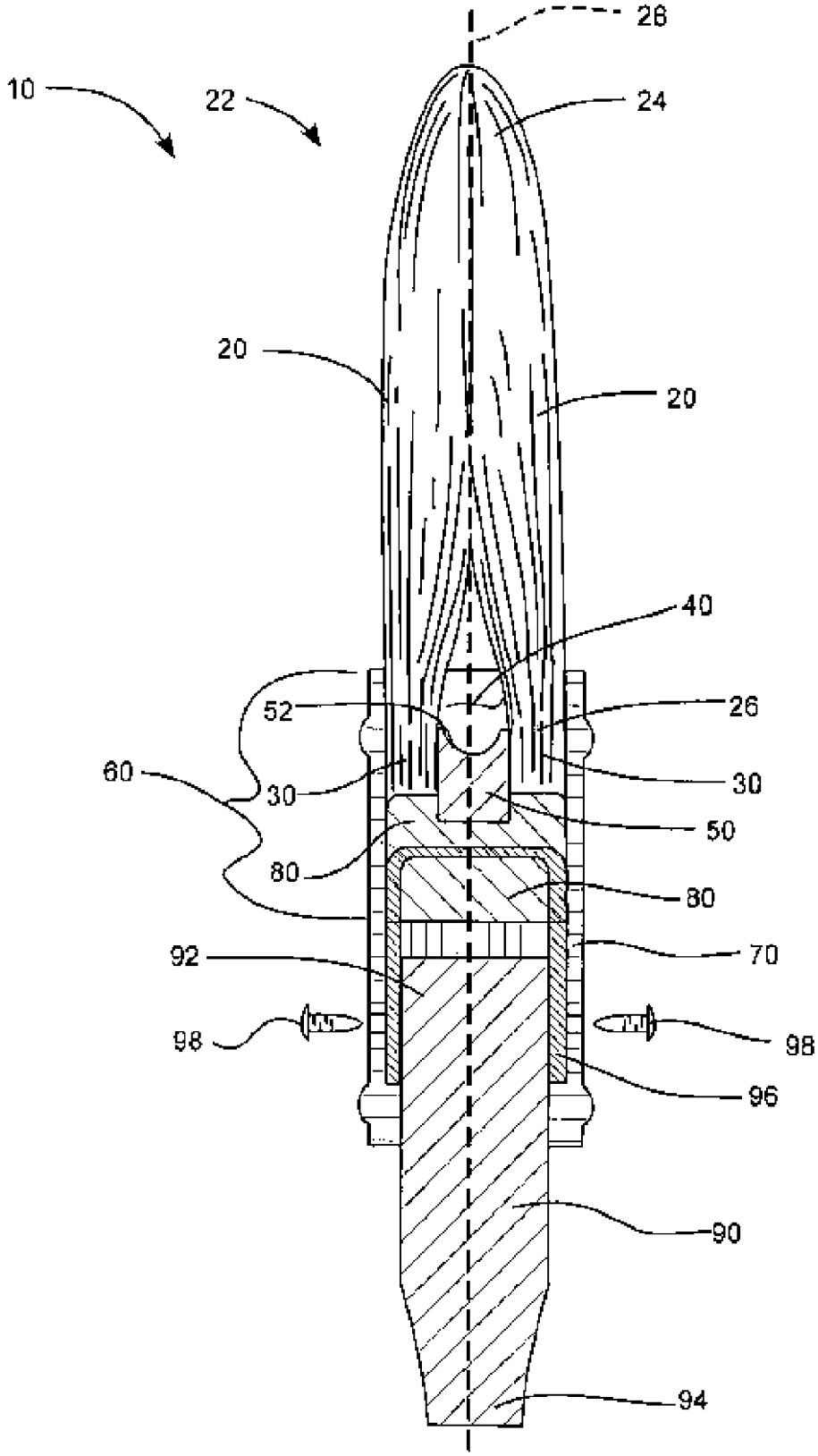
FIG. 1 is a cross section side view of a brush in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The embodiments of the present invention described herein generally provide for a paint brush having a greater paint carrying capacity. The paint brush can include a plurality of filaments that collectively form a brush head. A plug can be inserted into an end of the brush head so as to form a space between the plurality of filaments. The space between the filaments can act as a paint reservoir that can store paint in the brush head. The plug can have a concave end that faces the space formed between the filaments. The concave end can increase the size of the paint reservoir so that more paint can be stored in the brush head.

It is noted that, as used in this specification and the appended claims, the singular forms "a," "an," and "the" include plural referents unless the context clearly dictates otherwise.

Additionally, as used herein, "plurality" refers to more than one. For example, a plurality of filaments refers to at least two filaments.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of components may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

As used herein, the term "filament" refers to any fiber, strand, or string-like element which, when placed with other fibers or strands, can form a brush head. For example, a filament can be a natural fiber, such as animal hair, or a synthetic fiber, such as nylon string, polybutylene strands, and the like. Additionally, the terms filament, fiber, and bristle may be used interchangeably throughout this description.

As used herein the term "brush" refers to any collection of filaments or bristles coupled to a handle for purposes of transferring a chemical from the brush to a surface. For example, a brush can be a paint brush that can transfer paint, lacquer, varnish, stain, water sealant, and the like from a container to a surface.

Figure 2:
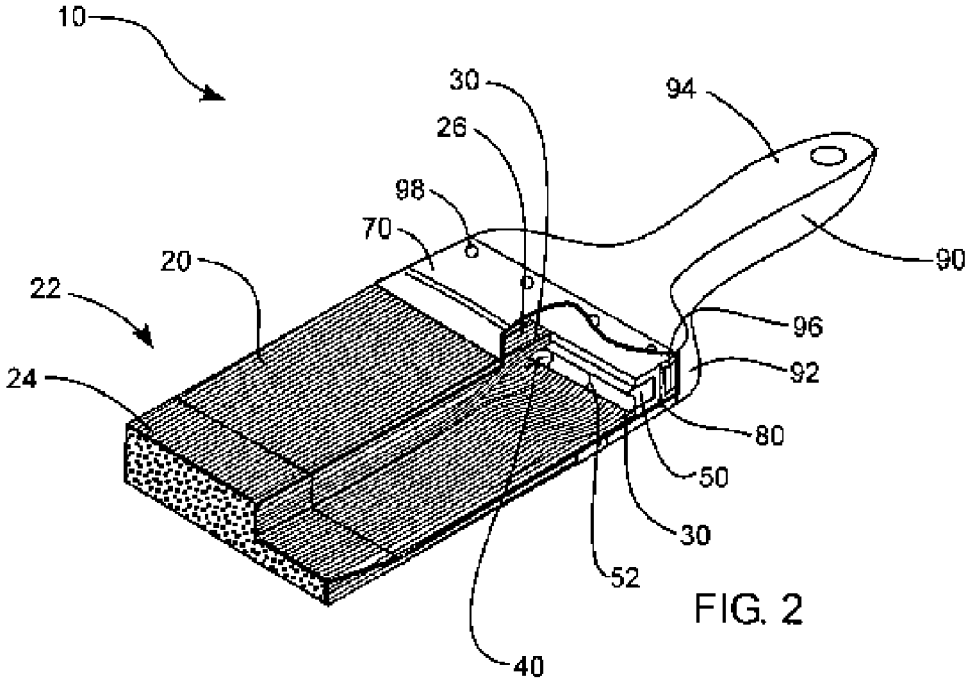
FIG. 2 is a cut-away perspective view of the brush of FIG. 1.

Thus, as illustrated in FIGS. 1-2, a brush, indicated generally at 10, in accordance with an embodiment of the present invention is shown for use transferring coatings such as paint, stain, lacquer, varnish, clear coat, water sealant, and the like to a surface. In one aspect, the brush 10 can be a paint brush. The brush 10 can have a plurality of filaments 20, and a plug 50 disposed in the filaments.

The filaments 20 can be formed of a natural or synthetic material, and collectively the plurality of filaments 20 can form a brush head, indicated generally at 22. The brush head 22 can have an application end 24 and an attachment end 26.

It will be appreciated that the application end 24 can be variety of shapes and angles with respect to the longitudinal axis 28 of the brush head. For example, in one aspect, the application end 24 can have an arcuate cross section, as shown in FIG. 1. In another aspect, the application end 24 can have a substantially flat cross section perpendicular to the longitudinal axis 28 of the brush head, as shown in FIG. 2. Additionally, the application end 24 can have an angled orientation with respect to a longitudinal axis 28 of the brush.

Figure 3:
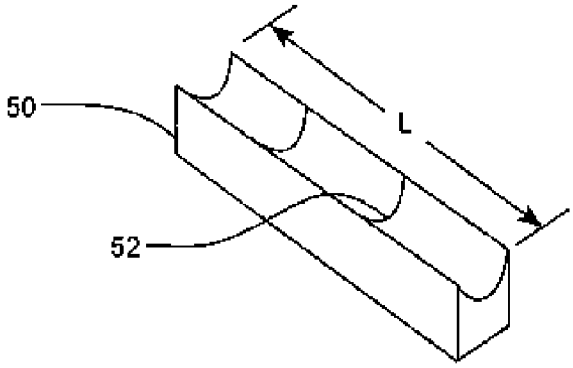
FIG. 3 is perspective view of a plug of the brush of FIG. 1.
Figure 4:
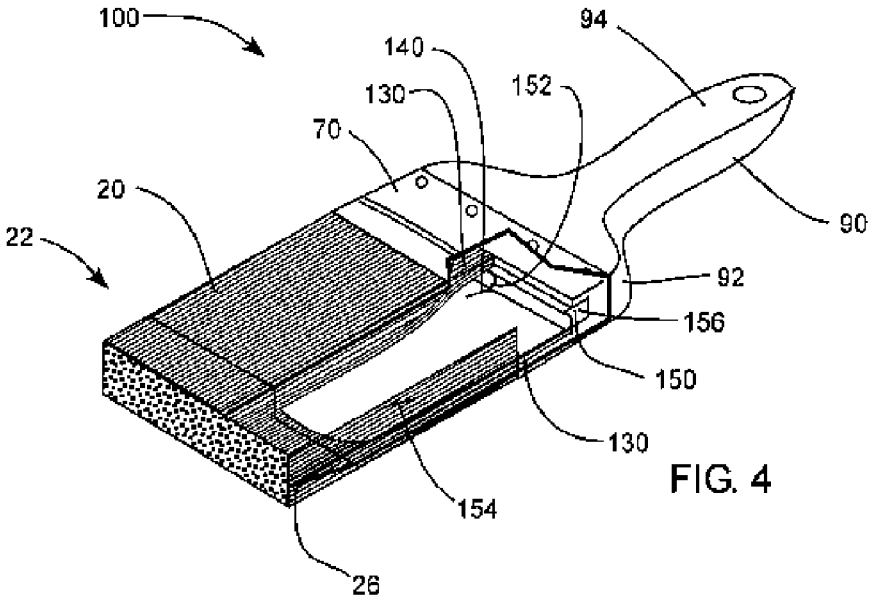
FIG. 4 is a cut-away perspective view of a brush in accordance with another embodiment of the present invention.
Figure 5:
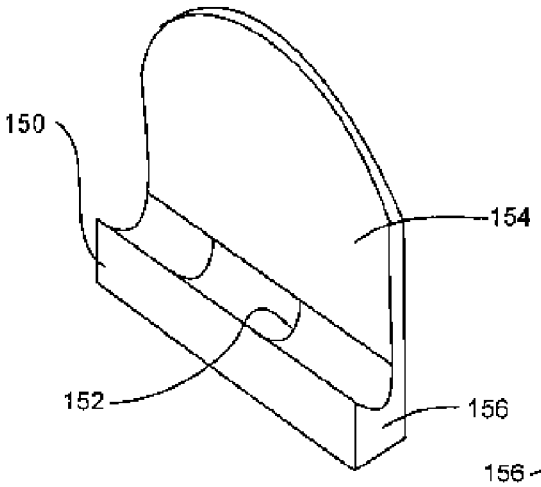
FIG. 5 is perspective view of a plug of the brush of FIG. 4.

Referring to FIGS. 1-3, the plug 50 can be disposed between the filaments 20 near the attachment end 26 of the brush head 22. In one aspect, the plug 50 can separate the filaments 20 into approximately equal halves 30 of the brush head 22, and can form a space 40 between the halves. The space 40 can form a reservoir that can store coating material when the brush 10 is dipped into a coating material.

Additionally, the plug 50 can have a concave end 52 formed in the plug. The concave end 52 can extend along a longitudinal length, L, of the plug 50. The plug 50 can be positioned in the filaments 20 such that the concave end 52 faces, or is open to, the space 40 formed between the filaments. In this way, the concave end 52 advantageously increases the size of the reservoir such that the brush head 22 can store more coating material than a brush head having a plug with a flat end.

The plug 50 can be formed a substantially non-permeable material such as a polymer, a closed cell foam, a plastic, and the like. In this way, the plug 50 can resist absorption of the coating material. It will be appreciated that a plug 50 made of a permeable material can absorb the coating material which can make the brush 10 difficult to clean and can cause the plug 50 to swell and deform. When such deformation of the plug occurs, the plug can affect the shape of the brush head. In contrast, the non-permeable material used in the plug 50 of the present invention resists absorption of the coating material and, thus, advantageously retains the size and shape of the brush head 22 and facilitates cleaning of the brush.

The brush 10 can also include a sleeve 70 circumscribing the ends of the plurality of bristles 20 forming the attachment end 26 of the brush head 22. The sleeve 70 can also circumscribe the plug 50 such that the plug can wedge the ends of the plurality of bristles 20 forming the separated halves 30 of the attachment end 26 of the brush head 22 against the sleeve 70.

In this way, the sleeve 70 can clamp and hold the brush head 22 and plug 50 in place. Accordingly, the sleeve 70 can be a ferrule, as known to those of skill in the art.

The sleeve 70 can be formed of a suitably rigid plastic or metal material so as to provide the clamping force on the bristles 20 disposed between the plug 50 and the sleeve 70. Additionally, the sleeve 70 can be formed of a substantially non-permeable material so as to resist absorption of the coating material.

The brush 10 can also include a resin 80 disposed within the sleeve 70. The resin 80 can surround the plug 50 and the ends of the filaments 20 forming the attachment end 26 of the brush head 22. In this way, the resin 80 can hold the ends of the plurality of bristles 20 and the plug 50 together within the sleeve 70. The resin 80 can be an adhesive type resin, an epoxy type resin, an epoxy resin with adhesive properties, and the like. Together, the resin 80, the plug 50, and the attachment end 26 of the brush head 22, can form a brush knot, indicated generally at 60. The brush knot 60 can hold the brush head 22 in place in relation to the sleeve 70.

The brush 10 can also include a handle 90 circumscribed by the sleeve 70 and coupled to the attachment end 26 of the brush head 22 by the sleeve 70. The handle 90 can have an attachment end 92 and a grip 94. The attachment end 92 can be circumscribed by the sleeve 70 and can be attached to the ends of the filaments 20 forming the attachment end 26 of the brush head 22. The resin 70 can attach the attachment end 92 of the handle 90 to the attachment end 26 of the brush head 22.

The grip 94 can extend away from the attachment end 92 of the handle 90 and away from the brush head 22. The grip 94 can be sized and shaped to be held in the hand of a user.

A reinforcement bracket 96 can be disposed within the resin and can extend around the attachment end 92 of the handle 90. The reinforcement bracket 96 can reinforce the attachment of the handle 90 to the brush head 22. The reinforcement bracket 96 can be formed of a metal material or a rigid polymeric material.

A plurality of fasteners 98 can attach the sleeve 70 to the attachment end 92 of the handle 90. For example, the fasteners 98 can be nails or brads, as shown in FIG. 1. The fasteners 98 can extend through the sleeve 70 and into the attachment end 92 of the handle 90. Other suitable fasteners, such as staples, screws, and the like can also be used to attach the sleeve to the handle.

Additionally, adhesives, such as glue, epoxy, and the like, can also be used to attach the sleeve to the handle.

As illustrated in FIGS. 4-7, a brush, indicated generally 100, is shown in accordance with another embodiment of the present invention for use in transferring coatings from a container to a surface. The brush 100 can be similar in many respects to the brush 10 described above and shown in FIGS. 1-3. Accordingly, the brush 100 can have a plurality of filaments 20 forming a brush head 22, a handle 90, and a sleeve 70 circumscribing the attachment end 26 of the brush head 22 and the attachment end 92 of the handle 90.

Additionally, the brush 100 can have a plug 150 disposed between the filaments 20 and forming a space 140 between the plurality of filaments 20. The plug 150 can separate the filaments 20 into separated portions 130 of the brush head 22, and can form the space 140 between the separated portions 130. The space 140 can form a reservoir that can store coating material when the brush 100 is dipped into a coating material. The plug 150 can also have a concave end 152 that faces the space 140 formed between the filaments 20. The concave end 152 can increases the size of the reservoir such that the brush head 22 can store more coating material than a brush head 22 having a plug with a flat end.

The plug 150 can also have a flange 154 that can extend from a body 156 of the plug 150 through the space 140 between the filaments 20 and into the application end 26 of the filaments. The flange 150 can extend nearly the entire length of the filaments 20. For example, in one aspect, the filaments 20 can have a length of approximately 4 inches and the flange can extend approximately 3.75 inches into the bristles. In another aspect, the filaments can extend approximately 3 inches from the sleeve 70 and the flange 150 can extend approximately 2 inches from the sleeve. Advantageously, the length of the flange 150 in relation to the length of the filaments 20, and the extension of the flange 150 into the brush head 22 can be adjusted by pulling the filaments 20*a* way from the flange 150 and cutting the flange 150 to the desired length within the filaments 20.

Figure 6:
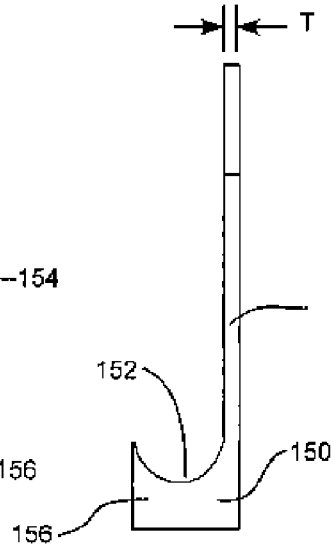
FIG. 6 is a side view of a plug of the brush of FIG. 4, shown with a flange having a relatively thinner cross section.
Figure 7:
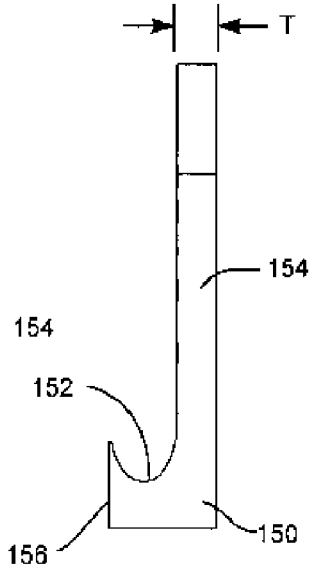
FIG. 7 is a side view of a plug of the brush of FIG. 4, shown with a flange having a relatively thicker cross section.

The flange 150 can have a thickness, indicated as T. The thickness T of the flange 150 can provide a greater stiffness than the filaments 20 such that the flange 150 can support the filaments 20 and stiffen the brush head 22. The thickness T can be predetermined according to a desired stiffness of the brush 100. Thus, the flange 150 can have a relatively smaller thickness, as shown in FIG. 6, if a less stiff brush 100 is desired. Alternatively, the flange 150 can have a relatively larger thickness, as shown in FIG. 7, if a stiffer brush 100 is desired.

The flange 154 can be formed as a separate piece from the body 156 of the plug 150 and then attached to the plug. Alternatively, the flange 154 can be integrally formed with the plug 150 and can be non-permeable to resist absorption of the coating material, and facilitate cleaning of the brush 100.

It is a particular advantage of the embodiments of the brush 100 of the present invention described herein that the flange 154 can increase the stiffness of the brush head 22. It will be appreciated that finer, thinner, or smaller diameter filaments 20 on a brush provide a better feel and greater precision when transferring a coating material to a surface. Additionally, finer bristles 20 can produce a very smooth coating layer, whereas course or larger bristles can variegate the final coating surface leaving a rougher surface finish. Thus, paint brushes with very fine filaments are highly valued by skilled painters. Unfortunately, the stiffness of the filaments is directly related to the thickness or diameter of the filament so that very fine filaments have a relatively low stiffness. It will be apparent that filaments with low stiffness can collapse and become floppy under the weight of a coating material disposed on the filament. For this reason, filament size has been limited to diameters that can maintain the shape of the brush under the weight of a coating on the filaments. Thus, the flange 154 of the brush 100 of the present invention can, advantageously, reduce the collapse and floppiness of the brush head 22 when the filaments 20 are covered and weighted down with the coating material.

Figure 8:
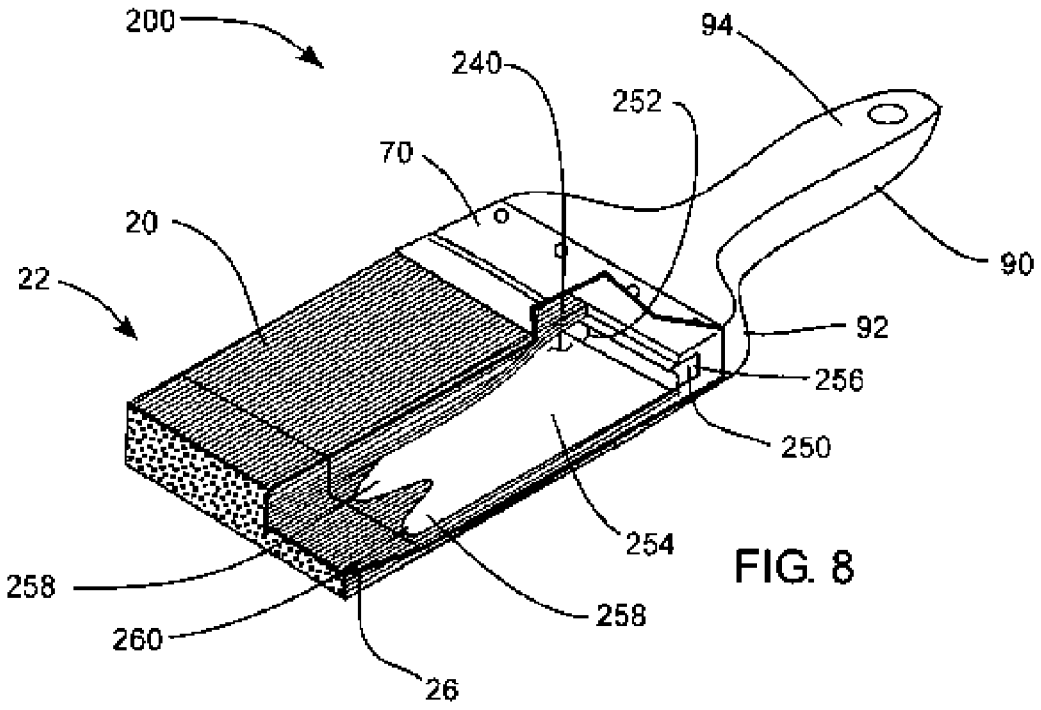
FIG. 8 is a cut-away perspective view of a brush in accordance with another embodiment of the present invention.
Figure 9:
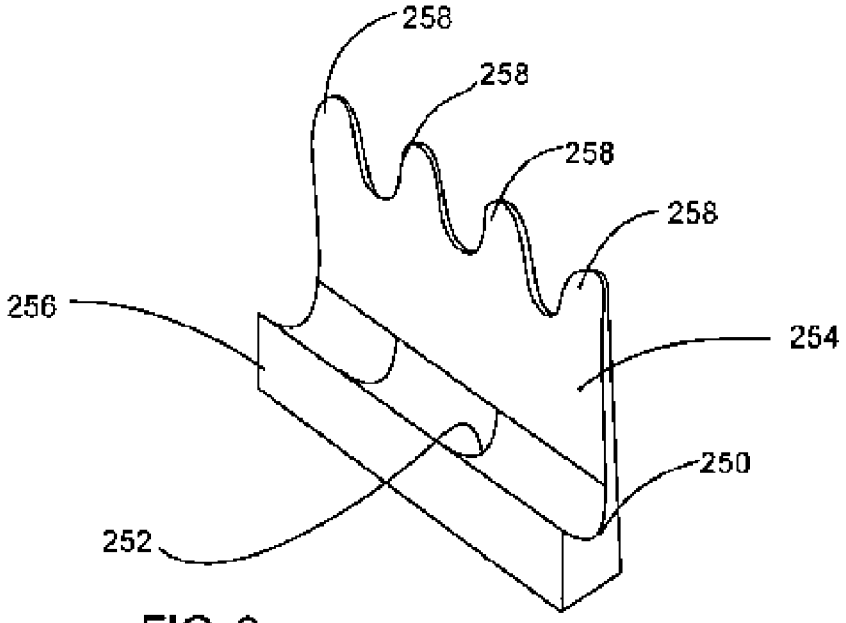
FIG. 9 is perspective view of a plug of the brush of FIG. 8.

As illustrated in FIGS. 8-9, a brush, indicated generally 200, is shown in accordance with another embodiment of the present invention for use in transferring coatings from a container to a surface. The brush 200 can be similar in many respects to the brush 10 and 100 described above and shown in FIGS. 1-7. Accordingly, the brush 200 can have a plurality of filaments 20 forming a brush head 22, a handle 90, a sleeve 70 circumscribing the attachment end 26 of the brush head 22 and the attachment end 92 of the handle 90, and a plug 250 with a flange 254 extending from a plug body 256 into the application end 26 of the brush head 22. The plug body 256 can have a concave side 252.

Additionally, the flange 254 can include a plurality of fingers 258 extending from the plug 250 into the plurality of filaments 20. The plurality of fingers 258 can support the plurality of filaments 20 in order to stiffen the brush head 22. The plurality of fingers 258 can also allow coating material to flow from the reservoir or space 240 past the fingers 258 to the filaments 20 on the other side of the flange 250. As shown in FIGS. 8-9, the fingers 258 can be relatively short extending along an outer end 260 of the flange 250.

Figure 10:
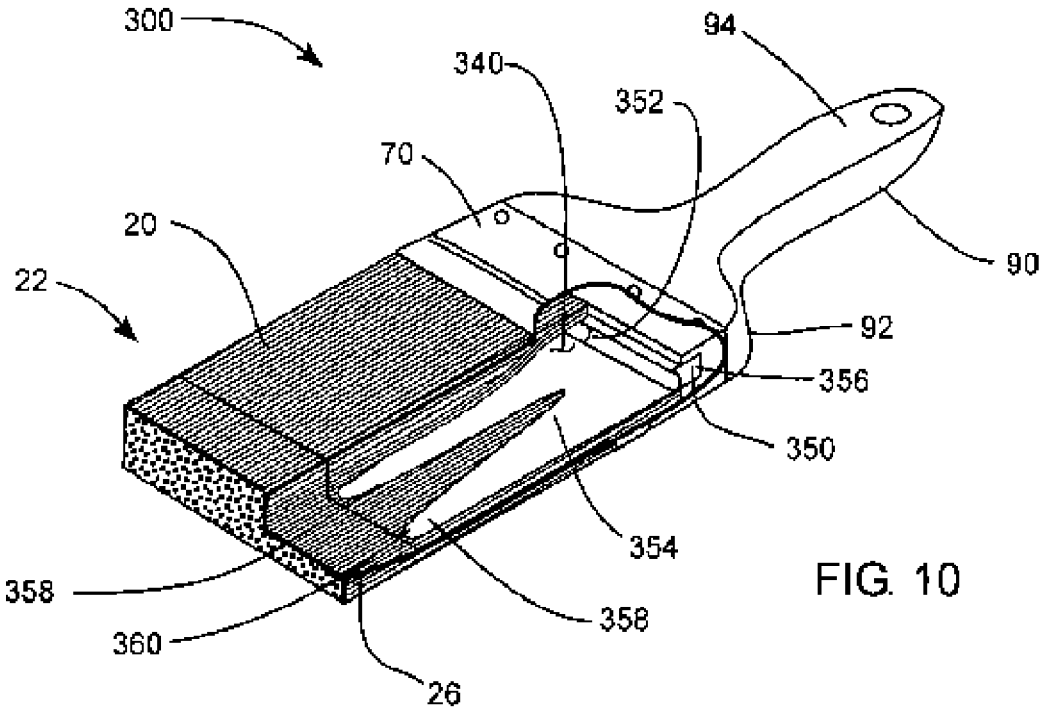
FIG. 10 is a cut-away perspective view of a brush in accordance with another embodiment of the present invention.
Figure 11:
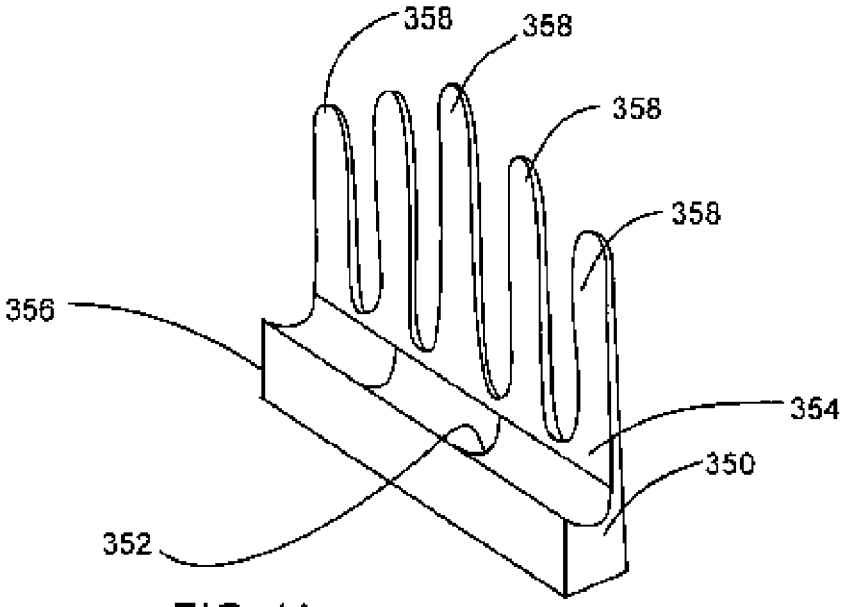
FIG. 11 is perspective view of a plug of the brush of FIG. 10.

As illustrated in FIGS. 10-11, a brush, indicated generally 300, is shown in accordance with another embodiment of the present invention for use in transferring coatings from a container to a surface. The brush 300 can be similar in many respects to the brush 10 described above and shown in FIGS. 1-7. Accordingly, the brush 300 can have a plurality of filaments forming a brush head 22, a handle 90, a sleeve 70 circumscribing the attachment end 26 of the brush head 22 and the attachment end 92 of the handle 90, and a plug 350 with a flange 354 extending from a plug body 356 into the application end 26 of the brush head 22.

Additionally, the flange 354 can include a plurality of fingers 358 extending from the plug body 356 into the plurality of filaments 20. The plurality of fingers 358 can support the plurality of filaments 20 to stiffen the brush 300. The plurality of fingers 358 can also allow coating material to flow from the space 340 or reservoir past the fingers 358 to the filaments 20 on the other side of the flange 350. As shown in FIGS. 10-11, the fingers 358 can be relatively long extending from an outer end 360 or periphery of the flange 350 to a position adjacent the body 356 of the plug 350.

Advantageously, the fingers 258 and 358 can have a predetermined length corresponding to a desired stiffness of the brush. Accordingly, a stiffer brush 200 can have shorter fingers 258, as shown in FIGS. 8-9, and a floppier brush 300 can have longer fingers 358, as shown in FIGS. 10-11. Similarly, the flange 254 or 354 can have a varied number of fingers 258 or 358 according to a desired stiffness of the brush. For example, a stiffer brush can have fewer fingers and a floppier brush can have more fingers.

Figure 12:
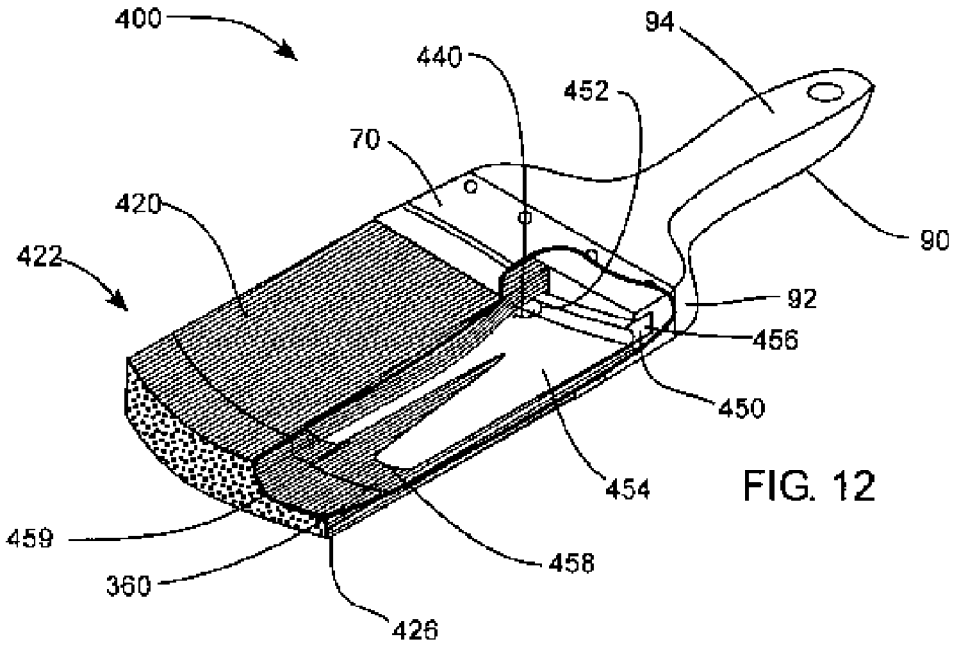
FIG. 12 is a cut-away perspective view of a brush in accordance with another embodiment of the present invention.
Figure 13:
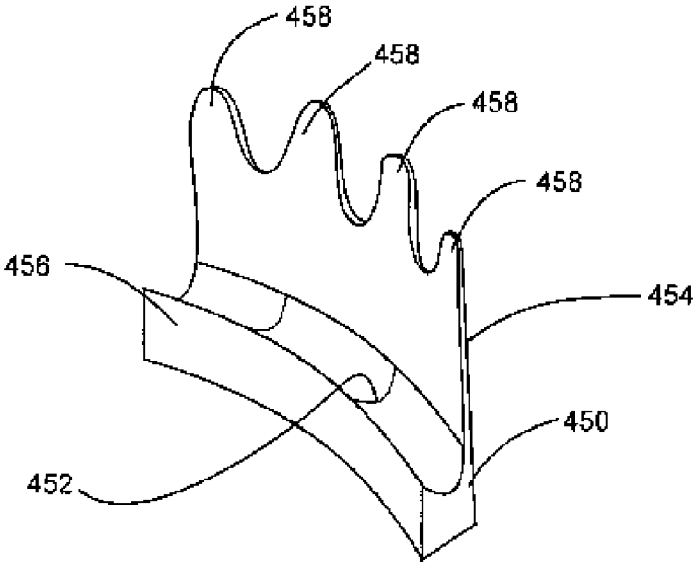
FIG. 13 is perspective view of a plug of the brush of FIG. 12.
Figure 14:
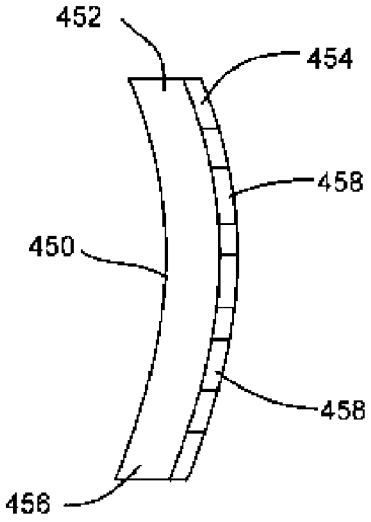
FIG. 14 is a top view of the plug of FIG. 12

As illustrated in FIGS. 12-14, a brush, indicated generally 400, is shown in accordance with another embodiment of the present invention for use in transferring coatings from a container to a surface. The brush 400 can be similar in many respects to the brush 10, 100, 200, and 300 described above and shown in FIGS. 1-11. Accordingly, the brush 400 can have a plurality of filaments 420 forming a brush head 422, a handle 90, a sleeve 70 circumscribing the attachment end 426 of the brush head 422 and the attachment end 92 of the handle 90, and a plug 450 with a flange 454 extending from a plug body 456 into the application end 426 of the brush head 422.

Additionally, the filaments 420 can be positioned to form a brush head 422 into a predetermined shape. For example, as shown in FIG. 12, the filaments 420 forming the brush head 422 can be positioned to form a brush head having a U-shaped cross section. Specifically, in one aspect, the cross section of the brush head 422 that is in a plane, indicated by dashes lines at 430, perpendicular to a longitudinal axis, indicated by a dashed line at 432, of the brush 400 or handle 90 can be shaped in the form of the letter U. In this way, the shape of the brush head 422 can have a concave side that can be concave about a longitudinal axis 434 that is substantially parallel to a longitudinal axis of the brush 432.

It will be appreciated that a U-shaped cross section facilitates applying an even coating to a wide variety of surfaces since the U-shape of the brush head allows a painter to gradually apply, or feather the coating material to the surface. Thus, it is a particular advantage of the embodiments of the brush 400 described herein that the predetermined shape of the brush head 422 can facilitate the application of a coating material to a surface, and although only a U-shaped cross section brush head 422 is shown, other shapes are considered within the scope of the concepts of the present invention. For example, the predetermined shape of the brush head can be an arc, a semi-circle, a U shape, a V shape, and the like.

Conveniently, the predetermined shape of the brush head 422 can be formed by a plug 450 formed of a similar shape. Thus, as shown in FIGS. 12-14, the plug 450 can have a U-shaped cross section, and a U-shaped flange 454 can extend from the plug body 456 into the application end 426 of the filaments 420. The plug 450 can position the filaments 20 in order to form the predetermined shape of the brush head 422. In this way, the U-shaped flange 454 can support and position the filaments 420 of the brush head 422 into a U-shape. Thus, the plug 450 and the flange 454 can position the filaments 420 such that the predetermined shape of the brush head 422 can have a U-shaped cross section in a plane 430 that is oriented substantially perpendicular to a longitudinal axis 432 of the brush 400.

Figure 15:
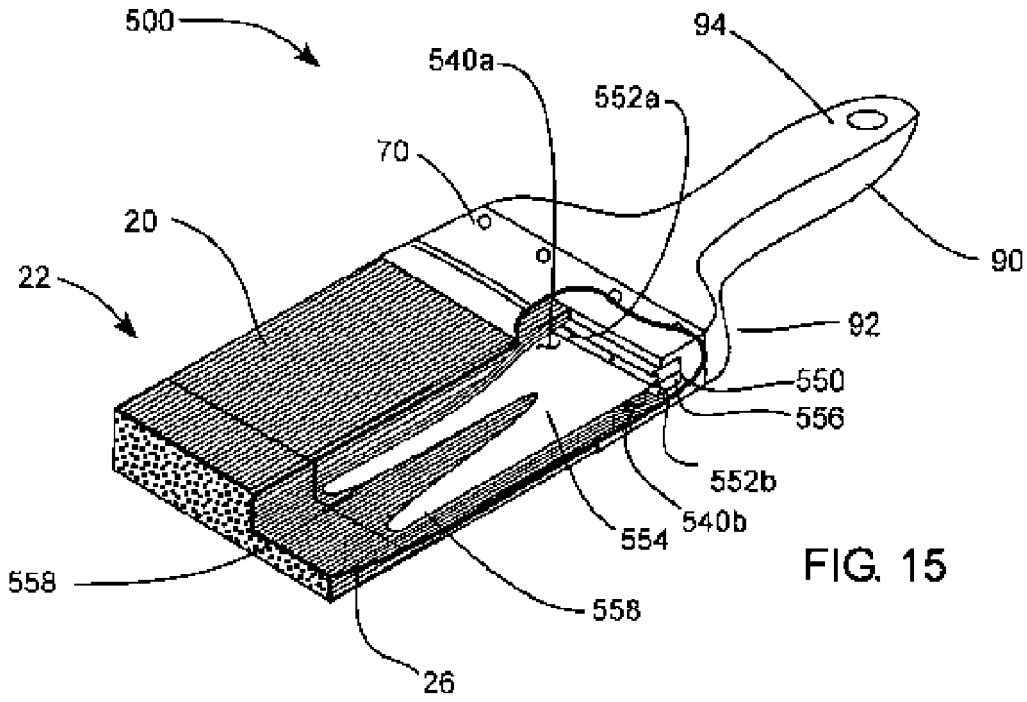
FIG. 15 is a cut-away perspective view of a brush in accordance with another embodiment of the present invention.
Figure 16:
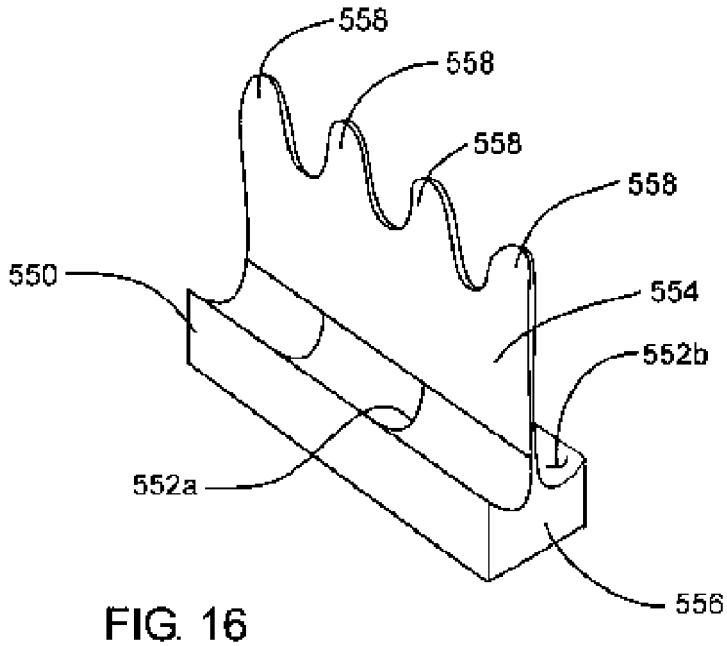
FIG. 16 is perspective view of a plug of the brush of FIG. 15.

As illustrated in FIGS. 15-16, a brush, indicated generally 500, is shown in accordance with another embodiment of the present invention for use in transferring coatings from a container to a surface. The brush 500 can be similar in many respects to the brushes 10, 100, 200, 300 and 400 described above and shown in FIGS. 1-14. Accordingly, the brush 500 can have a plurality of filaments 20 forming a brush head 22, a handle 90, a sleeve 70 circumscribing the attachment end 26 of the brush head 22 and the attachment end 92 of the handle 90, and a plug 550 with a flange 554 extending from a plug body 556 into the application end 26 of the brush head 22.

Additionally, the flange 554 can extend from an approximate center of the plug 550 into the plurality of filaments 20, and the plug body 556 can have a concave side 552*a* and 552*b* on either side of the flange 554. In this way, a coating reservoir 540*a* and 540*b* can be formed on either side of the flange 554. Thus, as either side of the brush head 22 is applied to a surface, coating material from the reservoir can be transferred from the reservoir to the brush head and onto the surface.

Although the embodiments of brushes described herein, and shown in the figures, only illustrate brush heads having one plug, it will be appreciated that the inventive concepts may be used with brushes that have a sufficiently thick brush head so as to require more than one plug.

The present invention also provides for a method for making a brush including placing a plurality of filaments into a sleeve such that ends of the plurality of filaments extend beyond the sleeve. A plug can be inserted into the ends of the plurality of filaments to form a space between the filaments. The plug can have a concave end of that faces the space so that the concave end and the space together define a coating reservoir within the plurality of filaments. The plug and the plurality of filaments can be slid into the sleeve so that the plug wedges the filaments against the sleeve.

The method can also include pouring a resin into the sleeve to contact the plurality of filaments and the plug. A handle can then be inserted into the sleeve so that the sleeve can hold the plurality of filaments, the plug, and the handle together.

The present invention also provides a method for applying a coating with a brush including dipping a plurality of filaments into a container of coating material such that coating material covers the filaments and fills a reservoir disposed between the filaments. The reservoir can include a concave end of a plug disposed between the filaments. The coating covered filaments can be slid along a surface to transfer the coating from the filaments to the surface. The coating covered filaments can be pressed against the surface to transfer substantially all of the coating in the reservoir to the filaments, including coating in the concave end of the plug. The filaments can be slid again along the surface to transfer additional coating from the reservoir and filaments to the surface.

Figure 17:
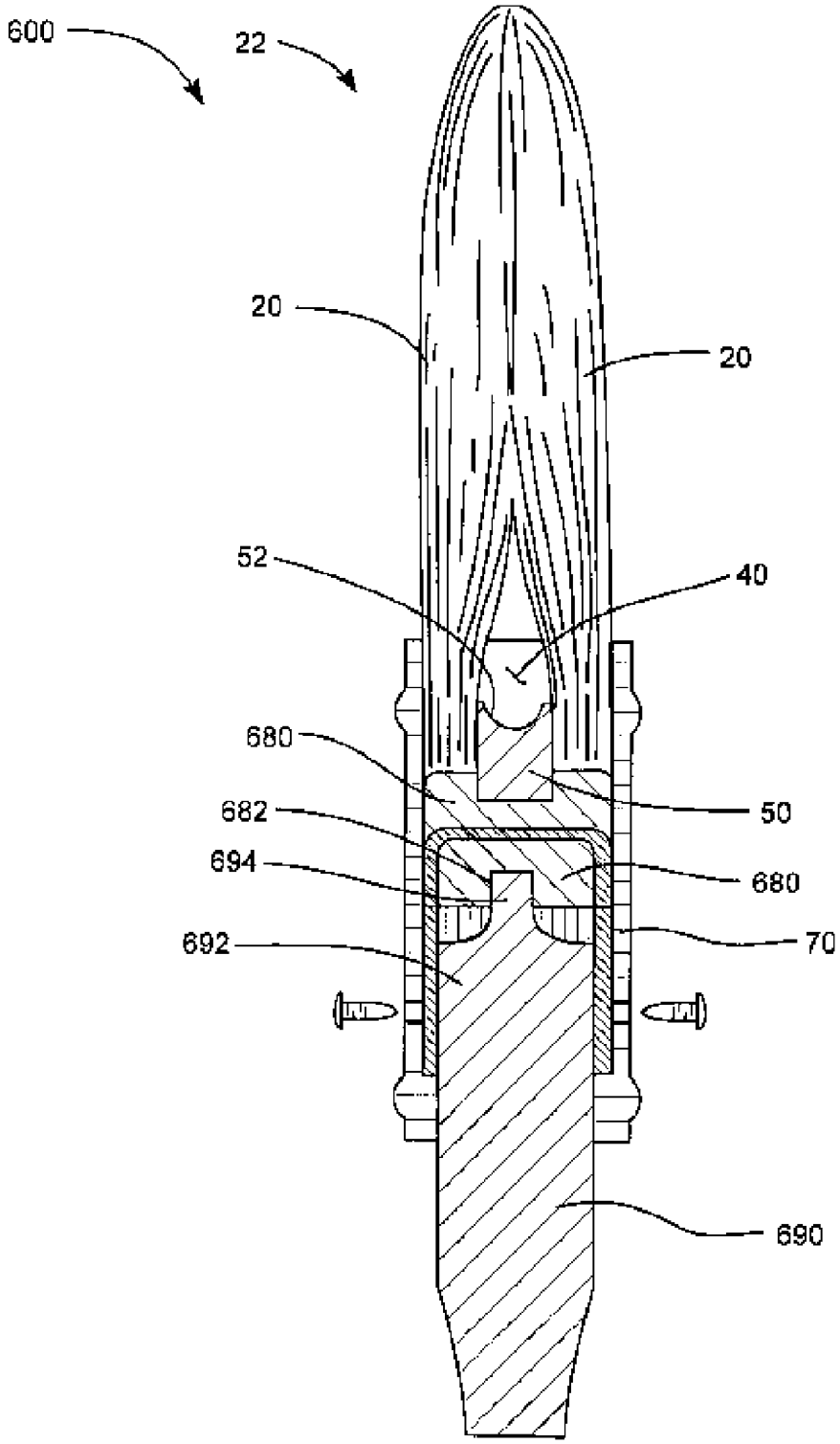
FIG. 17 is a cross section side view of a brush in accordance with another embodiment of the present invention.

As illustrated in FIG. 17, a brush, indicated generally at 600, is shown in accordance with another embodiment of the present invention. The brush 600 can be similar in many respects to the brushes 10, 100, 200, 300, 400, and 500 described above and shown in FIGS. 1-16. Accordingly, the brush 600 can have a plurality of filaments 20 forming a brush head 22, a handle 690, a sleeve 70 circumscribing the attachment end 26 of the brush head 22 and the attachment end 692 of the handle 690, and a plug 50 with a concave end 52 forming a space 40 between the filaments 20.

Additionally, the attachment end 692 of the handle 690 can have an extension 694 that can extend away from the handle 690 and into the resin 680. The extension 694 can have a smaller cross section than the attachment end 692 of the handle 690. The resin 680 can have a slot or recess 682 that can correspond in size and shape to the extension 694. The recess 682 can receive the extension 694 such that the extension and the recess mate together.

The extension 694 can have a substantially zero-clearance fit within the recess 682. In one aspect, the extension 694 can form the recess 682 when the attachment end 692 of the handle 690 is inserted into the sleeve 70 prior to curing of the resin 680 such that the resin flows around the extension. In this way, the extension can increase the surface area of the attachment end 692 of the handle 690 with respect to flat or blunt end of the handle, and, thus, increase the adhesive connection between the handle 690 and the resin 680. Additionally, the extension 694 and recess 682 can provide a mechanical lock between handle 690 and the resin 680 so as to reduce independent movement of the handle 690 with respect to the brush head 22.

It is a particular advantage that the extension 694 strengthens the connection between the brush head 22 and the handle 690. It will be appreciated that adhesive and mechanical attachment between the handle 690 and the brush head 22 can be broken by repeated pressing of the brush against a surface. Similarly, corrosive effects by the chemicals of the coatings the brush is applying can weaken and cause failure in the connection between the brush head 22 and the attachment end 692 of the handle 690. When the connection between the brush head 22 and handle 690 is weakened or broken, the sleeve 70 can keep the brush head and handle together, but the brush head can develop a slight rock or wiggle with respect to the handle. This movement between the brush head 22 and the handle 690 can result in inaccuracies and loss of precision in the application of the coating to the surface. Thus, advantageously, the extension 694 can increase the adhesive connection between the handle 690 and the resin 680, and reduce independent movement of the handle 690 with respect to the brush head 22.

Figure 18:
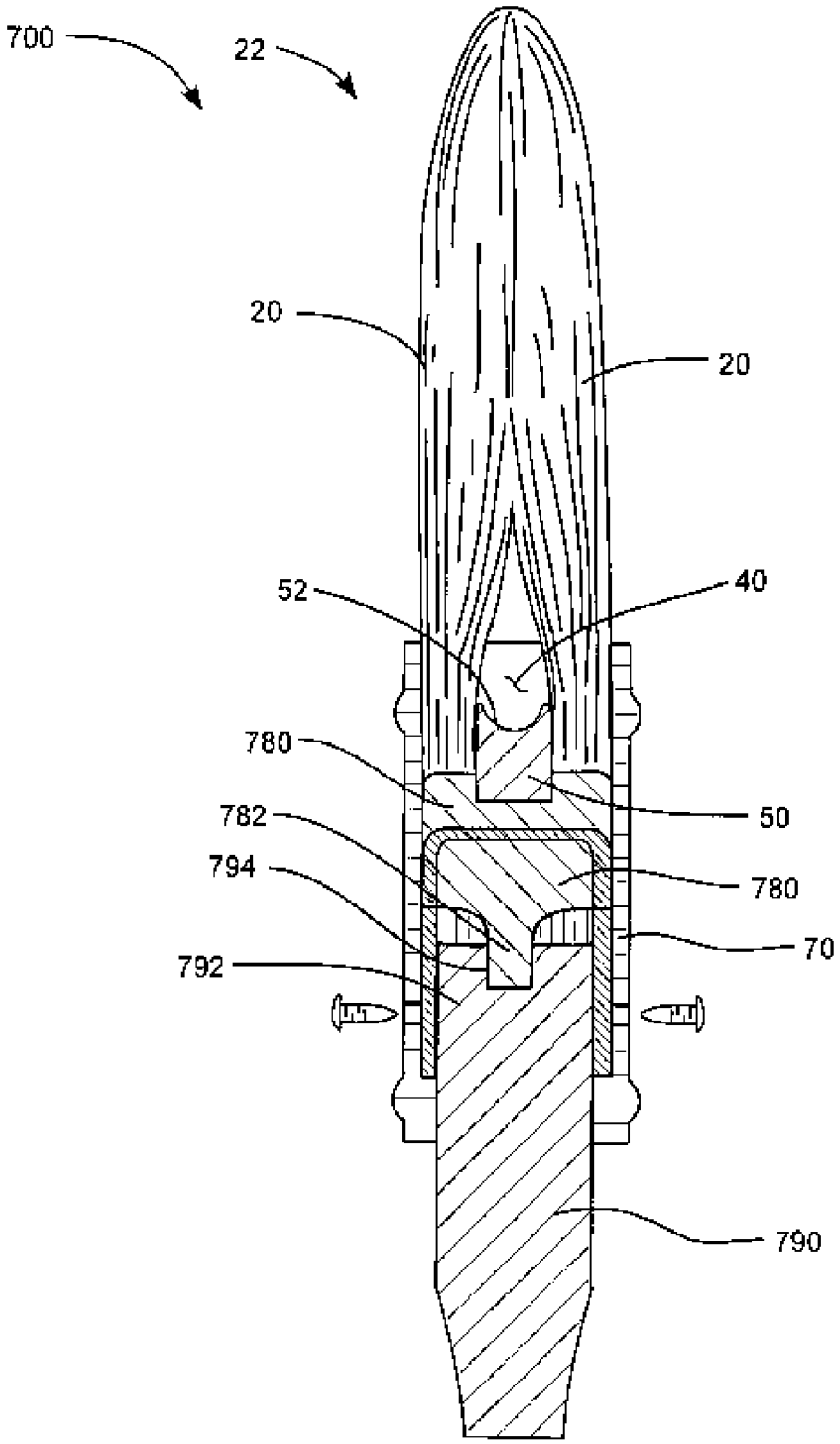
FIG. 18 is a cross section side view of a brush in accordance with another embodiment of the present invention.

As illustrated in FIG. 18, a brush, indicated generally at 700, is shown in accordance with another embodiment of the present invention. The brush 700 can be similar in many respects to the brush 600 described above and shown in FIG. 17. Accordingly, the brush 700 can have a plurality of filaments 20 forming a brush head 22, a handle 790, a sleeve 70 circumscribing the attachment end 26 of the brush head 22 and the attachment end 792 of the handle 790, and a plug 50 with a concave end 52 forming a space 40 between the filaments 20.

Additionally, the attachment end 792 of the handle 790 can have a slot or recess 794 that can extend into the attachment end 792 of the handle 790. The recess 794 can have a smaller cross section than the attachment end 792 of the handle 790. The resin 780 can have an extension 782 that can correspond in size and shape to the recess 794 in the handle. The recess 794 can receive the extension 782.

The extension 782 can have a substantially zero-clearance fit within the recess 794. In one aspect, the recess 794 can form the extension 782 when the attachment end 792 of the handle 790 is inserted into the sleeve 70 prior to curing of the resin 780 such that the resin flows into the recess 794. In this way, the recess 794 can increase the surface area of the attachment end 792 of the handle 790, and, thus, increase the adhesive connection between the handle 790 and the resin 780. Additionally, the recess 794 and extension 782 can provide a mechanical lock between handle 790 and the resin 780 so as to reduce independent movement of the handle 790 with respect to the brush head 22.

Figure 19:
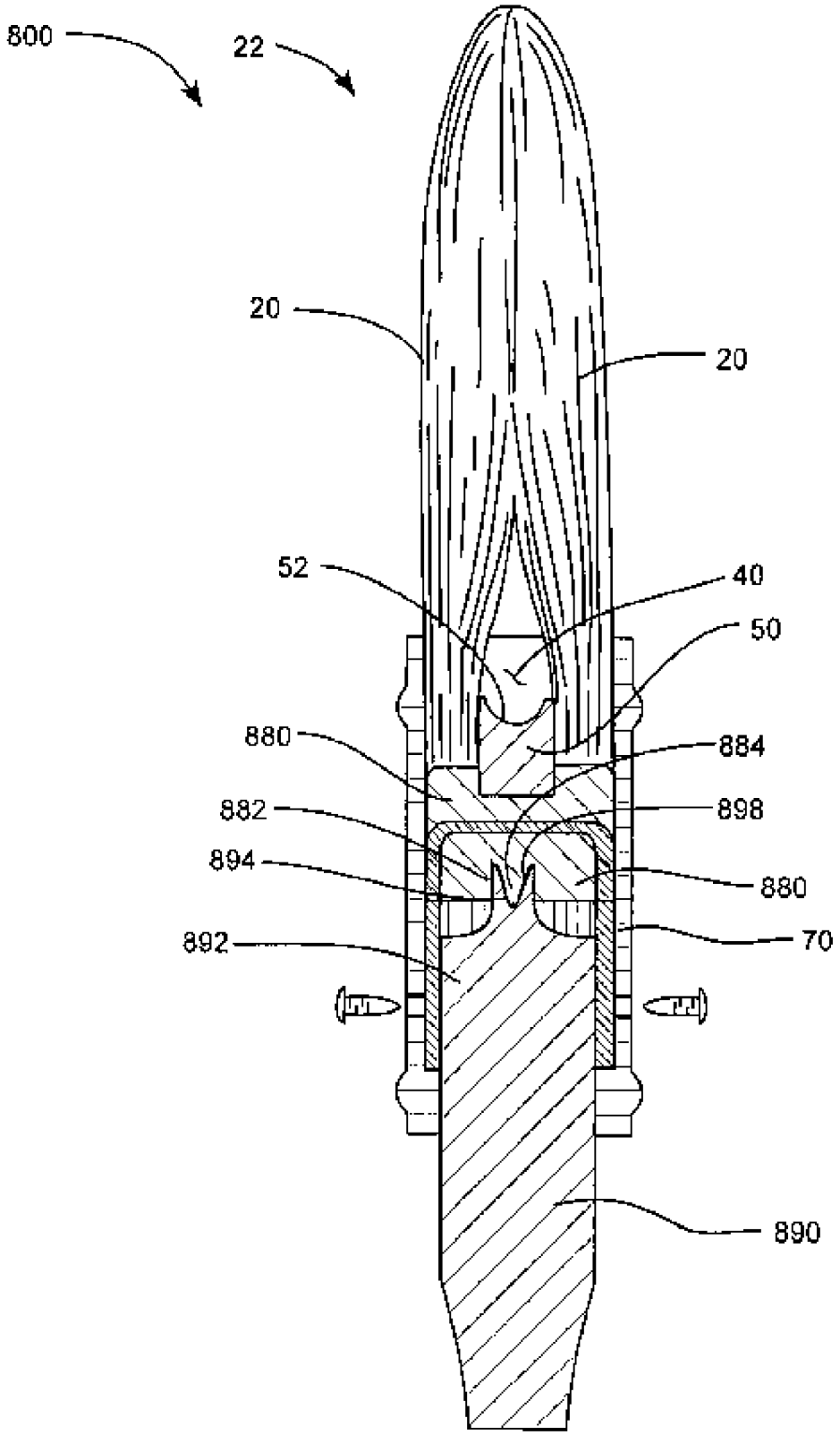
FIG. 19 is a cross section side view of a brush in accordance with another embodiment of the present invention.

As illustrated in FIG. 19, a brush, indicated generally at 800, is shown in accordance with another embodiment of the present invention. The brush 800 can be similar in many respects to the brushes 600 and 700 described above and shown in FIGS. 17-18. Accordingly, the brush 800 can have a plurality of filaments 20 forming a brush head 22, a handle 890, a sleeve 70 circumscribing the attachment end 26 of the brush head 22 and the attachment end 892 of the handle 890, and a plug 50 with a concave end 52 forming a space 40 between the filaments 20.

Additionally, the attachment end 892 of the handle 890 can have an extension 894 that can extend away from the handle 890 and into the resin 880. The extension 894 can have a smaller cross section than the attachment end 892 of the handle 890. Additionally, the extension 894 can have a groove 898 that can extend along a longitudinal length of the extension 894. The groove 898 can be of sufficient size and shape so as to allow resin 880 to fill the groove to further reduce independent movement of the handle with respect to the plurality of bristles.

Thus, the resin 880 can have a slot or recess 882 that can correspond in size and shape to the extension 894 and the groove 898. The recess 882 can receive the extension 894, and a portion 884 of the resin 880 can substantially fill the groove 898.

The extension 894 can have a substantially zero-clearance fit within the recess 882. In one aspect, the extension 894 can form the recess 882 when the attachment end 892 of the handle 890 is inserted into the sleeve 70 prior to curing of the resin 880 such that the resin flows around the extension 894 and into the groove 898. In this way, the extension 894 and groove 898 can increase the surface area of the attachment end 892 of the handle 890, and, thus, increase the adhesive connection between the handle 890 and the resin 880. Additionally, the extension 894, groove 898 and recess 882 can provide a mechanical lock between handle 890 and the resin 880 so as to reduce independent movement of the handle 890 with respect to the brush head 22.

The present invention also provides for a method for making a paint brush including placing a plurality of bristles inside a sleeve. A resin can be applied into the sleeve to contact the plurality of bristles. A handle can be inserted into the sleeve to contact the resin. An extension formed in one of the handle or the resin can be fitted into a recess formed in the other of the handle and the resin.

The method can also include allowing the resin to at least partially cure before inserting the handle. Additional resin can then be applied into the sleeve to contact the at least partially cured resin. The handle can be inserted into the sleeve to contact the uncured and at least partially cured resin.

Figure 20:
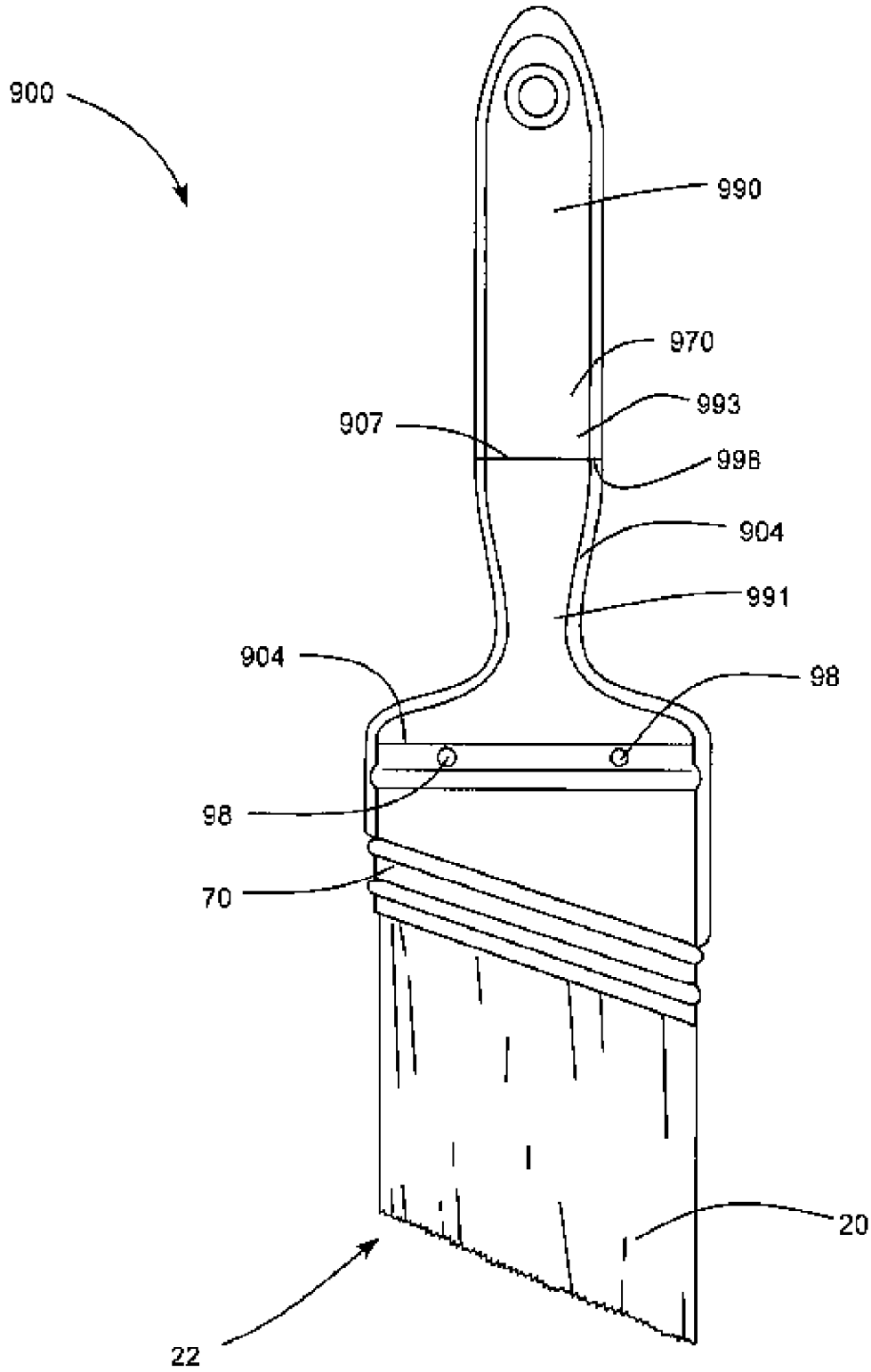
FIG. 20 is a front view of a brush in accordance with another embodiment of the present invention, shown with a protective coating over an interface between a handle and a sleeve of the brush.
Figure 21:
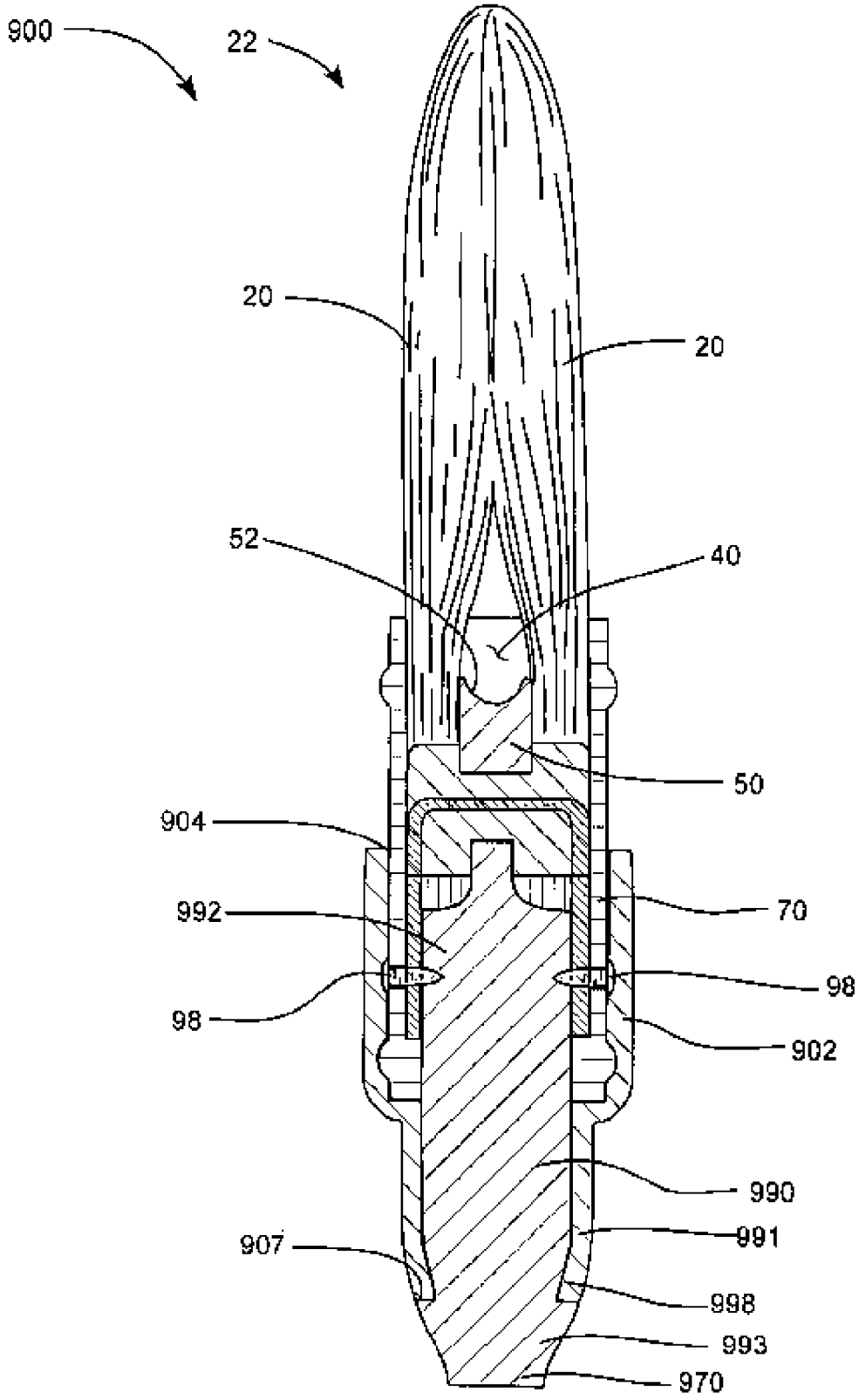
FIG. 21 is a cross section side view of the brush of FIG. 20.

As illustrated in FIGS. 20-21, a brush, indicated generally at 900, is shown in accordance with another embodiment of the present invention. The brush 900 can be similar in many respects to the brushes 10, 100, 200, 300, 400, 500, 600, 700, and 800 described above and shown in FIGS. 1-19. Accordingly, the brush 900 can have a plurality of filaments 20 forming a brush head 22, a handle 990, a sleeve 70 circumscribing the attachment end 26 of the brush head 22 and the attachment end 992 of the handle 990, and a plug 50 with a concave end 52 forming a space 40 between the filaments 20.

Additionally, the brush 900 can include a coating 902 that can cover the brush attachment end 26 of the brush head 22, the attachment end 992 of the handle 990, and at least a portion of the grip 970. Thus, in one aspect, the coating 902 can extend over an interface 904 between the attachment end 992 of the handle 990 and the sleeve 70 so as to reduce exposure of the interface to chemicals from the coating materials the brush head 22 may be dipped into.

In this way, the coating 902 can form a seal around at least a portion 991 of the handle 990 and at least a portion of the sleeve 70 to reduce absorption of chemicals by the handle 990. The coating 902 can include materials that are resistant to chemical damage, such as elastomers, polymers, polyurethanes, natural rubbers, synthetic rubbers, a plastics, polyvinyl chlorides, flouropolymers, polytetrafluoroethylenes, and the like. In one aspect, the coating 902 can form a surface substantially impermeable to chemicals such paint, stain, solvent, cleaning agents, soap, water, and the like. Additionally, the coating 902 can form a smooth surface or a texturized surface on the handle that can facilitate holding the brush.

The handle 990 can have a recess 998 extending along the portion 991 of the handle 990 that is coated. The recess 998 can correspond in size to the thickness of the coating 902 such that an end 907 of the coating 902 is substantially level with an uncoated portion 993 of the handle 990. In this way, the transition from the material of the handle 990 to the coating 902 can be relatively unnoticeable with respect to the surface level of the handle 990. Thus, it will be appreciated that a painter may notice a tactile change in the surface of the handle 990, but may not notice a surface elevation or level change in the surface of the handle 990.

The coating provides the brush 900 with several advantages. For example, the coating 902 reduces exposure of the interface 904 between the sleeve 70 and the handle 990 to potentially damaging chemicals. It will be appreciated that many painters prefer to use wooden handled brushes, and that wood, as a porous, open-celled foam material, can absorb the coating materials being applied to the brush. This absorption can cause the wood of the handle to become saturated and soft which can result in a loosening of the connection between the handle and the brush head, and a loosening of the brads 98 in the sleeve 70. Such loosening can cause the sleeve 70 and brush head 22 to move in relation to the handle 900 and can result in a decrease in the quality of the performance of the brush. Thus, the coating 902 on the brush 900 advantageously protects the interface 904 between the sleeve 70 and the handle 990, and also the placement of the brads 98 through the sleeve 70 and into the handle 990. In this way, the coating 902 can protect brushes with handles made from a permeable material such as an open cell foam, a foamed fibrous composite, wood, and the like.

The present invention also provides for a method for making a paint brush including placing a plurality of filaments inside a sleeve. The plurality of filaments can form a brush head. A plug can be inserted into the plurality of filaments to form a space between the filaments. The plug can have a concave end. The plug and the spaced apart filaments can be slid into the sleeve so that the plug wedges the filaments against the sleeve. A handle can be slid into the sleeve so that a brush attachment end of the handle abuts the plug and spaced apart filaments. The handle can be attached to the sleeve. A portion of the sleeve and a portion of the handle can be coated with a substantially impermeable coating in order to seal an interface between the sleeve and the brush attachment end of the handle to resist absorption of chemicals by the handle.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A method for making a paint brush, comprising:

a) placing a plurality of filaments inside a sleeve, the plurality of filaments forming a brush head;

b) sliding a handle into the sleeve so that a brush attachment end of the handle abuts the plurality of filaments;

c) attaching the handle to the sleeve; and d) coating with a substantially impermeable coating at least a portion of an outer surface of the handle and an outer surface of the sleeve without covering the plurality of filaments to form an outermost surface of the paint brush and a seal around an interface between the sleeve and the handle to resist absorption of chemicals by the handle.

2. The method of claim 1, further comprising:

a) inserting a plug into the plurality of filaments to form a space between the filaments; and b) sliding the plug and the spaced apart filaments into the sleeve so that the plug wedges the filaments against the sleeve.

3. The method of claim 1, wherein the coating forms a texturized surface on the handle.

4. The method of claim 1, wherein the coating forms a surface substantially impermeable surface to chemicals selected from the group consisting of paints, stains, solvents, soaps, water, and a combination thereof.

5. The method of claim 1, wherein the coating includes a material selected from the group consisting of an elastomer, a polymer, polyurethane, a natural rubber, a synthetic rubber, a plastic, polyvinylchloride, a flouropolymer, a polytetrafluoroethylene, and combinations thereof.

6. The method of claim 1, wherein the handle includes a permeable material selected from the group consisting of an open cell foam, a foamed fibrous composite, wood, and combinations thereof.

7. A method for making a paint brush, comprising:

a) coupling a plurality of filaments to a handle inside a sleeve with the handle extending out of the sleeve; and b) coating at least a portion of the handle and the sleeve with a substantially impermeable coating to form a seal around an interface between the sleeve and the handle without covering the plurality of filaments.

8. The method of claim 7, further comprising:

a) forming a brush head with a plurality of filaments inside a sleeve;

b) sliding a handle into the sleeve adjacent to the plurality of filaments; and c) attaching the handle to the sleeve.

9. The method of claim 7, wherein the coating forms a surface substantially impermeable surface to chemicals selected from the group consisting of paints, stains, solvents, soaps, water, and a combination thereof.

10. The method of claim 7, wherein the coating covers at least a portion of an outer surface of the handle and an outer surface of the sleeve to form an outermost surface of the paint brush.

11. The method of claim 7, wherein the seal formed by the coating protects the handle from absorption of chemicals applied by the brush.

12. A method for making a brush, comprising:

a) placing a plurality of filaments into a sleeve so that an end of the plurality of filaments extend beyond the sleeve;

b) inserting a plug into the end of the plurality of filaments to form a space between the filaments, with a concave end of the plug facing the space so that the concave end and the space together define a coating reservoir within the plurality of filaments;

c) sliding the plug and the ends of the plurality of filaments into the sleeve so that the plug wedges the ends of the filaments against the sleeve; and d) coating at least a portion of the handle and the sleeve with a substantially impermeable coating to form a seal around an interface between the sleeve and the handle without covering the plurality of filaments.

13. A method in accordance with claim 12, further comprising:

a) pouring resin into the sleeve to contact the plurality of filaments and the plug; and b) inserting a handle into the sleeve, the plurality of filaments, the plug, and the resin together forming a brush knot coupling the plurality of filaments to the handle.

* * * * *